US009279248B2

(12) United States Patent
Bradford

(10) Patent No.: US 9,279,248 B2
(45) Date of Patent: Mar. 8, 2016

(54) COVER PANEL SEISMIC EXPANSION JOINT

(71) Applicant: WATSON BOWMAN ACME CORP., Amherst, NY (US)

(72) Inventor: Paul Bradford, West Falls, NY (US)

(73) Assignee: Watson Bowman Acme Corp., Amherst, NY (US)

( * ) Notice: Subject to any disclaimer, the term of this patent is extended or adjusted under 35 U.S.C. 154(b) by 0 days.

(21) Appl. No.: 14/644,312

(22) Filed: Mar. 11, 2015

(65) Prior Publication Data

US 2015/0259901 A1 Sep. 17, 2015

Related U.S. Application Data

(60) Provisional application No. 61/951,104, filed on Mar. 11, 2014.

(51) Int. Cl.
*E04B 1/68* (2006.01)

(52) U.S. Cl.
CPC ..... *E04B 1/6803* (2013.01); *E04B 1/68* (2013.01); *E04B 1/681* (2013.01)

(58) Field of Classification Search
CPC ..... E04B 1/68; E04B 1/6803; E04B 1/681
See application file for complete search history.

(56) References Cited

U.S. PATENT DOCUMENTS

| | | | | |
|---|---|---|---|---|
| 3,435,574 | A * | 4/1969 | Hallock | 52/278 |
| 3,696,575 | A * | 10/1972 | Armstrong | 52/288.1 |
| 5,319,907 | A | 6/1994 | Nicholas et al. | |
| 5,829,216 | A | 11/1998 | Newcomb et al. | |
| 6,014,848 | A * | 1/2000 | Hilburn, Jr. | 52/396.04 |
| 6,430,884 | B1 * | 8/2002 | Shreiner et al. | 52/393 |
| 6,499,265 | B2 * | 12/2002 | Shreiner | 52/393 |
| 8,267,617 | B2 * | 9/2012 | Bradford et al. | 404/47 |
| 2015/0259901 | A1 * | 9/2015 | Bradford | E04B 1/6803 52/167.1 |

* cited by examiner

*Primary Examiner* — Andrew J Triggs
(74) *Attorney, Agent, or Firm* — Carrier Blackman & Associates, P.C.; Joseph P. Carrier; Anne G. Sabourin

(57) ABSTRACT

A seismic expansion joint cover assembly installed at an expansion gap between a first structural member on one side of a gap and a second member on the opposite side of the gap includes a cover panel bridging the gap having at least one hinged connector joining one edge of the cover panel to the first structural component to allow movement about an axis. The assembly includes at least one slide support which attaches to the second member, including an attachment flange, a track extending from the flange, and a lift component located on the track to lift the cover panel. A spring assembly attaches to the cover panel and engages the track and includes a spring plate with one or more springs attached thereto, a guide component attached to the spring plate and a saddle component having a grove to receive the guide component.

11 Claims, 6 Drawing Sheets

COVER PANEL SEISMIC EXPANSION JOINT

CROSS-REFERENCE TO RELATED APPLICATION

The present application claims priority under 35 U.S.C. 119(e), based on U.S. provisional patent application 61/951,104, filed 11 Mar. 2014. The entire disclosure of this priority document, including specification, claims, and drawings, is incorporated by reference herein.

BACKGROUND OF THE INVENTION

Technical Field of the Invention

The present invention relates to a device for supporting facades used on a structure, where the façade may be subject to movement relative to the supporting structure.

The use of facades in the construction industry enhances the aesthetic appearance of a structure and may provide thermal and sound insulation to the interior, rather than functioning as a load bearing member. Facades, as used herein, refers to panels or structural units attached to the exterior of an architectural structure or building, and the façade may be made of stone, masonry, glass, metal or other materials or combinations of such materials.

Such structures include wall expansion joints to accommodate displacements due to thermal expansion, wind loads, and earthquake (seismic) movements. Generally seismic displacements caused by earthquakes can be much larger than displacements caused under normal daily loads or moderate wind loads. Seismic displacements require a device which supports a facade for translational and/or pivotal movement relative to the supporting building. An expansion joint system designed to meet such displacements is highly desirable and not adequately addressed in the prior art.

SUMMARY OF THE INVENTION

The present invention provides a support for mounting a facade to a building to provide increased resistance to seismic disturbance. In preferred embodiments, the system may permit both limited translational and pivotal movement. The capability of permitting translational and pivotal movements minimizes the effect of building movement on the facade and its supports when the building oscillates in unpredictable patterns as a result of e.g., slip, strike-slip, oblique slip or separation type faults.

The seismic expansion joint cover assembly is a cover panel that bridges an expansion gap between structural members of a building or other structure such as a stadium, parking deck, or other architectural structure. The structural member, by way of non-limiting example, may be a wall or beam. The expansion joint cover is a cover panel including a coupler such as a hinge for connecting one side of the cover to an edge of a structural member on one side of the gap. The underside of the cover panel rides on slide supports and optionally angle supports, attached to a structural member on the opposite side of the gap bridged by the cover panel. Multiple slide supports and angle supports may be utilized depending on the size of the cover panel.

The slide support includes a flange and a track having a top surface and a bottom surface, and said track extends along an axis generally perpendicular to the flange. The flange attaches the slide support to the structure. The slide support further includes a wedge-shaped lift component having a sloped incline that may be along a straight or curved line. The lift component is located along the track to engage and lift the exterior panel when the panel or building moves. The support further includes a downwardly extending protrusion functional as a stop member to limit forward movement, located on the longitudinal track a distance from the flange. In one embodiment the stop component is located at the end of the track opposite the flange. The slide support engages a spring assembly. The spring assembly includes a spring plate and one or more springs integral with said spring plate. The spring plate attaches to the underside of the cover panel. The spring plate also includes a guide component integral therewith or attached thereto, and a saddle component that engages the bottom surface of the track. The saddle component has a proximal groove to engage the track and a distal groove or opening to engage the springs and hold them in place during movement.

Opening of the expansion joint is facilitated by the spring assembly attached to the cover panel. As the joint opens, the guide slides along the slide track and up the lift, and the panel swings or pivots into a partially open position. This prevents the panel from hitting an adjacent fixed wall panel on the structure.

Closing of the expansion joint is facilitated by the guide sliding on the slide track in the opposite direction until the stop component engages the spring assembly saddle and prevents it from disengaging from the slide track. The spring(s) in the spring assembly stretches to prevent the panel from excessive pivoting.

Angle brackets or supports, configured to form a 90 degree angle and comprising an appropriate metal or polymeric material may also be attached to the structural member at various locations to provide additional support to the cover panel. In one embodiment, the angle bracket may comprise two members at 90 degrees to each other, in another embodiment the bracket may be configured as a right isosceles triangle having three members. One member of the angle bracket is attached to the structural component and the cover panel moves slidably across the angle support when the expansion joint cover assembly is activated.

The present invention is useful as an expansion joint where seismic movement is not a consideration, as well as for the above described seismic expansion joint for cover panels on a structure.

For a better understanding of the invention, reference may be made to the following description of exemplary embodiments, taken in conjunction with the accompanying drawings.

DETAILED DESCRIPTION OF ILLUSTRATIVE EMBODIMENTS

Figure 1:
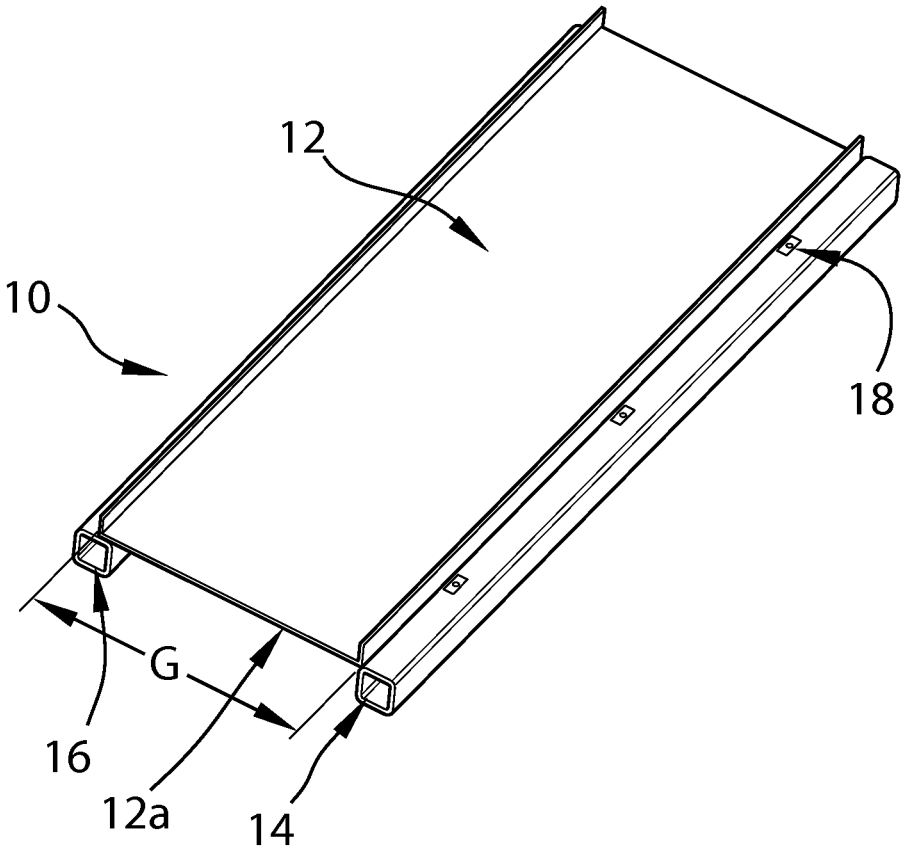
FIG. 1 is a top plan view of an embodiment of an exterior cover panel.

The present invention provides a seismic expansion joint cover assembly for mounting a facade to a building to allow a façade to move during high winds or a seismic disturbance and provides increased resistance to damage from a seismic disturbance. As shown in FIG. 1, the seismic expansion joint cover assembly 10 is installed at an expansion gap between a first structural member 14 on one side of a gap G and a second structural member 16 on the opposite side of the gap. The cover assembly includes a cover panel 12 that bridges the expansion gap between an edge of the first structural member 14 to which it attaches on one side of the gap and the second structural member 16 on the opposite side of the gap. The structural members are structural members of a building, stadium, parking deck or other architectural structure, and can be any suitable structural member to which an exterior panel may be attached, where non-limiting examples of the structural member include a wall, a beam, or a roof.

Figure 2:
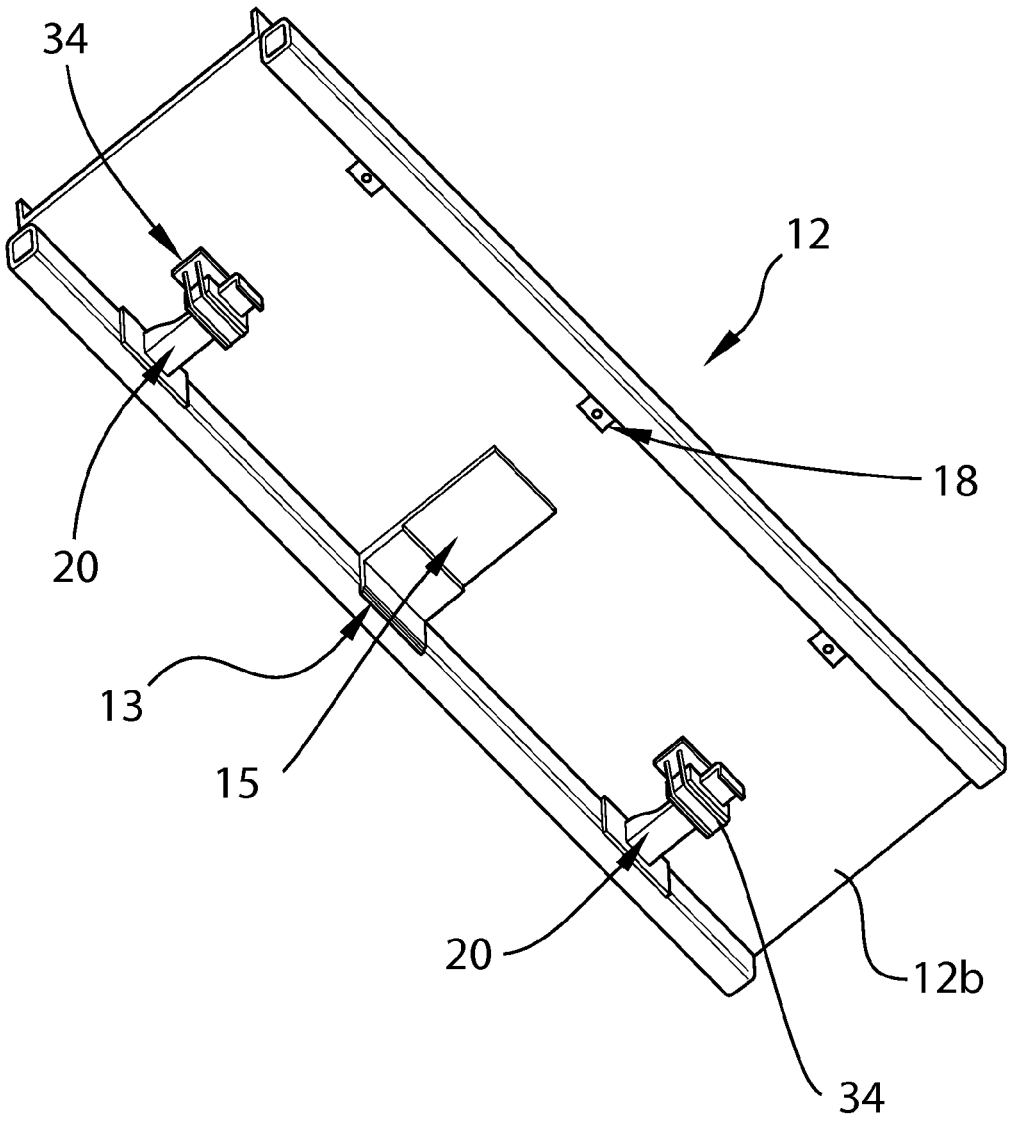
FIG. 2 is a bottom plan view of an exterior cover panel.
Figure 6:
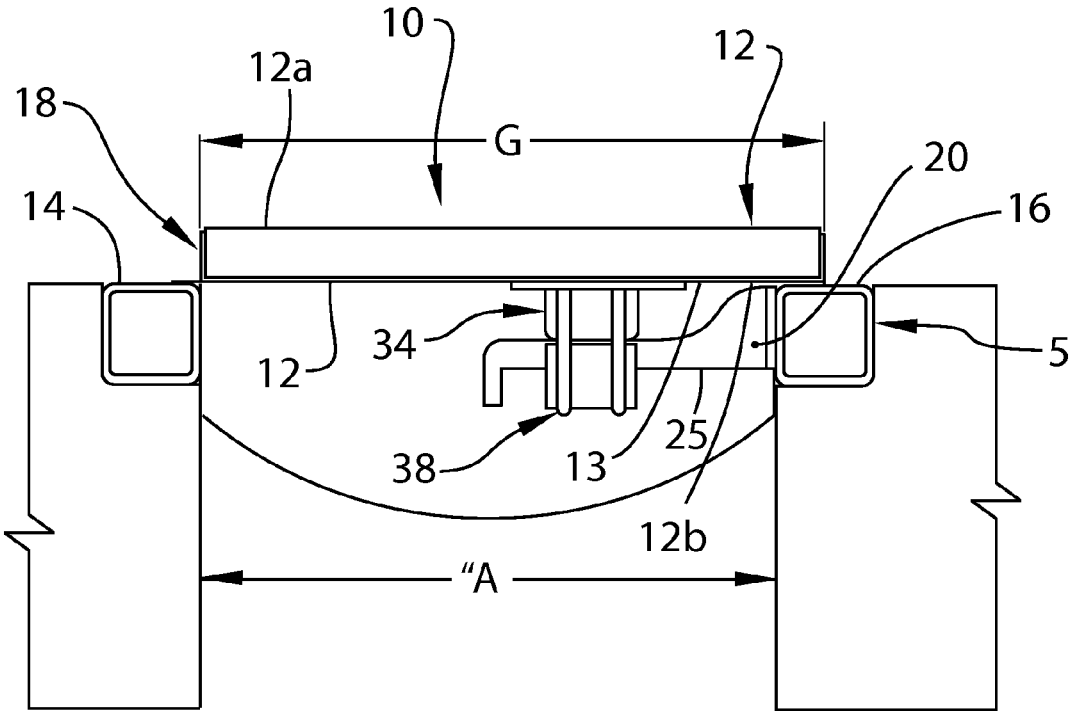
FIG. 6 is a perspective view of an installed expansion joint.

FIG. 1 illustrates an embodiment of the expansion joint cover assembly 10 including at least one moveable connector 18 that is connected to the structural member 14 and to the cover panel 12. The invention may be configured so that the moveable connector 18 may be attached to either structural member 14 or 16. FIG. 1 illustrates one embodiment of the invention. The moveable connector 18 in one embodiment is a pivoting connector joining the cover panel 12 to the structural member 14 to allow pivotal movement of the cover panel 12 about a pivot axis when the structure is subjected to seismic or other movement. The moveable connector 18, is pivotable about an axis and allows the cover panel to pivot is, in one embodiment, a hinge. The cover panel includes a top side 12*a* as shown in FIG. 1, and an underside 12*b*, as shown in FIG. 2. As shown in FIG. 2, the underside of the cover panel 12*b* slides on at least one slide support 20. As shown in FIG. 6, the slide support 20 is attached to a structural member 16. The slide support is attached to the structural member without the pivoting connector.

Figure 4:
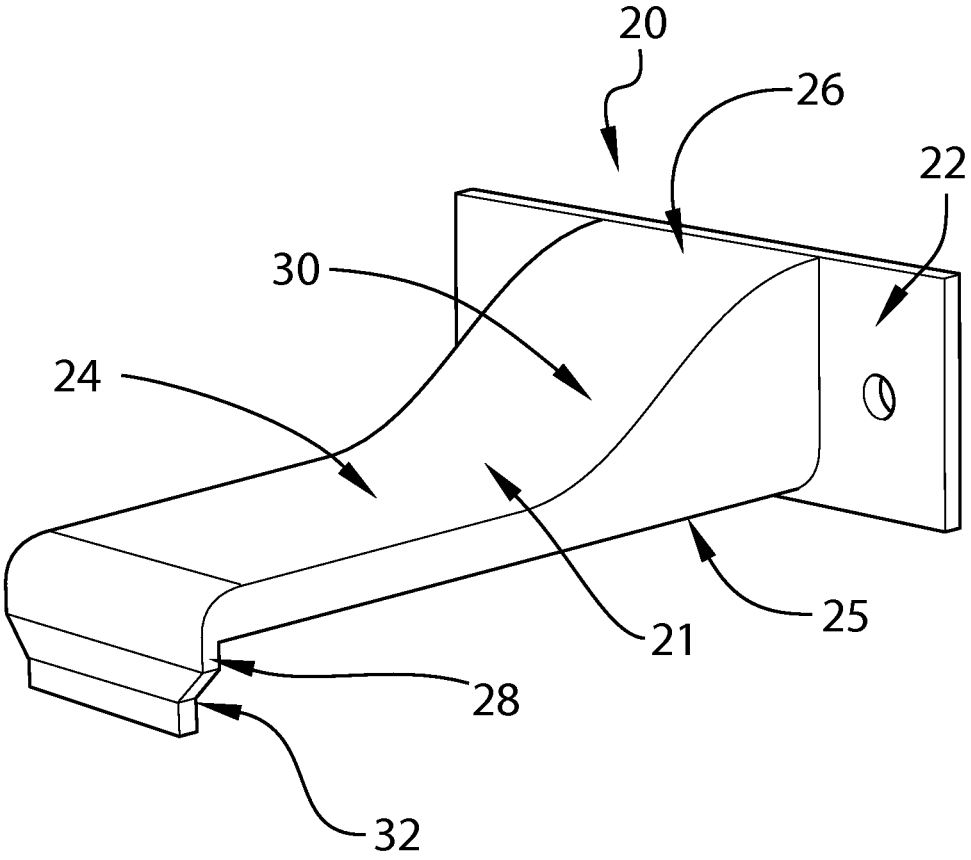
FIG. 4 is a detailed view of a slide assembly.

FIG. 4 illustrates a slide support 20, having a top side 21 and a bottom side 25, and including a flange 22 for attaching the slide support to a structural member, and a slide track 24 extending generally perpendicular to the flange, the flange having a flange end 26 and a stop end 28. The flange end of the slide support is located where the slide track 24 meets the flange 22, and the stop end is located at the end of the slide opposite the flange end. The slide track may be integral with the flange or removably attached thereto. The flange 22, in one embodiment, is attached to a structural member, for example, by means of fasteners or, in an alternative embodiment is welded to the structural member. The slide support further includes a lift component 30, (hereinafter lift), located on, or integral with the slide track 24. The lift component is generally wedge-shaped and has a sloped incline surface that may be along a straight or curved line, where the cover panel contacts the sloped incline to assist in lifting a cover panel during movement of the building and/or the panels. The wedge-shaped lift is located at the end closest to the flange end of the slide track. The slide track may be comprised of aluminum, or other suitable metal or polymer. The slide track in one embodiment is formed from aluminum and the wedge-shaped lift is integral with the slide Alternatively the lift may be formed separately from the slide track, and may be removably attached to the slide track with fasteners, or permanently affixed by welding or other appropriate means. The angle of the lift may be varied depending on the degree of pivot and/or translational movement desired. The slide support 20 further includes a stop component 32 located at the stop end 28 of the track opposite the flange. The stop component in one embodiment is a lip or protrusion extending in a direction that is downward from the underside of the cover panel. As shown in FIG. 6, the slide support engages with a spring assembly 34 to allow translational movement or pivoting of the cover panel when seismic, weather or other disturbances occur to cause movement of the building or cover panels.

Figure 5:
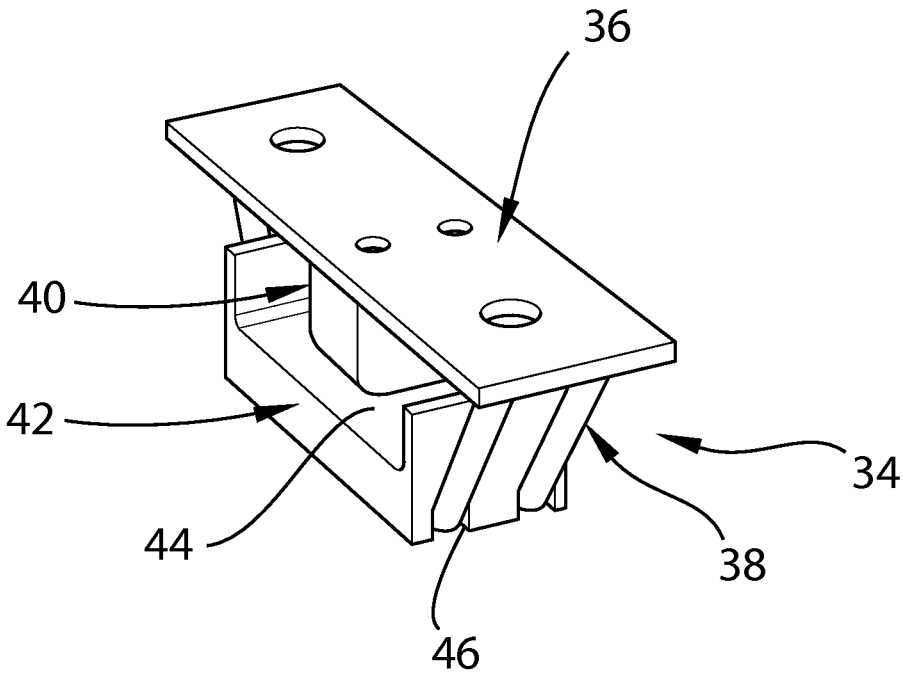
FIG. 5 is a detailed view of a spring assembly.

As shown in FIG. 5, the spring assembly 34 includes a spring plate 36 for mounting the assembly to a cover panel (not shown), and one or more springs 38 integral with or attached to said spring plate. In one embodiment steel coil springs are used and are integral with the spring plate. The springs may be of any suitable material of adequate strength for the desired application. In one embodiment, the spring plate is removably attached to the underside of the cover panel. Alternatively the spring plate may be permanently affixed to the cover panel by welding or other suitable methods. The spring plate also includes a guide component 40, integral therewith or attached thereto, for guiding movement along the slide track 24. During opening and closing of the of the expansion joint, the guide 40 slides over the top surface 21 of the slide track, which is the surface facing the underside of the cover panel 12*b*.

The spring assembly further includes a saddle component 42. As shown in FIG. 6, the saddle component engages the bottom side of the slide track 25, where the bottom side is the side of the track that faces away from the underside of the cover panel 12*b*. As shown in FIG. 5, the saddle 42 includes a proximal groove or recess 44, to engage the bottom side of the slide, and a distal groove or recess or opening 46 to engage the springs 38 and hold them in place. The stop 32 located on the slide track 24 engages the saddle 42 to prevent it from moving off the slide when expansion joint closes. The guide may move beyond the slide track, but returns to the slide track by retraction of the springs 38 to which it is attached. In one embodiment, the saddle and guide are comprised of a nylon polymer. Other suitable materials, preferably polymeric, may be used for these components.

In one embodiment the invention provides an expansion joint system which includes the seismic expansion joint cover assembly installed at an expansion gap between a first structural member on one side of a gap and a second structural member on the opposite side of a gap as described hereinabove.

Figure 3:
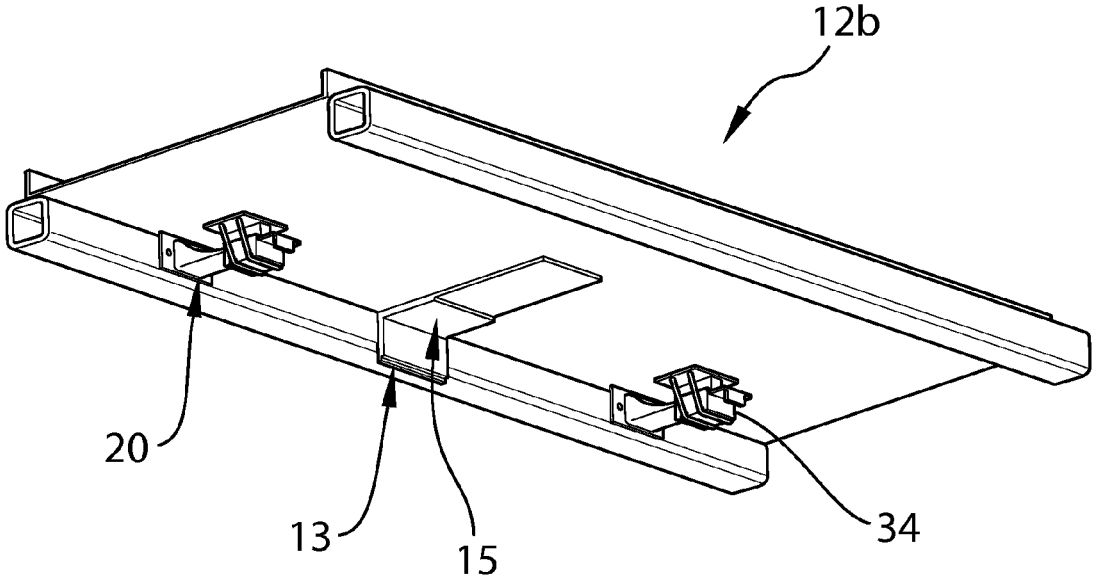
FIG. 3 is a bottom plan view of an exterior cover panel.

In embodiments shown in FIGS. 2 and 3, the expansion joint system includes an expansion cover panel 12 having one or more grooves or recesses 13 having a determined length and width, formed in the underside of the cover panel to movably or slidably receive one or more shelf supports which are angle brackets 15 with a width slightly less than that of the receiving groove or recess, where the angle bracket is attached to the structural member. The cover panel grooves 13 slidably engage one or more angle brackets 15 while the spring assembly 34 is engaged and the cover panel pivots or moves as the cover panel returns to its original position. The angle brackets are typically right angle brackets having two members at right angles to each other. In another embodiment the bracket may be configured as a right isosceles triangle having three members. One member of the bracket is attached to a structural member on the side of the gap to which the slide member is attached. The member orthogonal to the structural member provides a surface that is in contact with the cover panel grooves which slidably engage the angle support when the expansion joint cover assembly is activated. In another embodiment, the cover panel slides over the three-membered isosceles triangle brackets which do not engage the grooves in the cover panel and the two membered angle brackets slide in the grooves of the cover panel.

In an alternative embodiment additional angle supports may be provided which slidably engage the cover panel and do not engage the grooves in the cover panel. In yet another alternative embodiment, the cover panel does not have grooves to receive angle supports, and the cover panel slidably engages the angle supports during operation of the expansion joint cover assembly.

Opening of the expansion joint cover assembly 10 is facilitated by the spring assembly 34 attached to the cover panel 12. As an expansion joint opens, the guide component of the spring assembly slides along the slide track 24 toward and up the lift 30, and the panel swings or pivots into a partially open position. This prevents the panel from hitting an adjacent fixed cover panel on the structure.

Closing of the expansion joint cover assembly is facilitated by the guide component 40 sliding in the track 24 in the direction away from the lift 30, until the stop component 32 engages the spring assembly saddle 42 and prevents it detaching from the track. The spring 38 in the spring assembly 34 stretches to provide tension on the cover panel to prevent the panel from pivoting excessively.

The present invention has been described in an illustrative manner, and it is to be understood that the terminology which has been used is intended for the purpose of description rather than of limitation. Many modifications and variations of the present invention are possible in light of the above teachings. It is, therefore, to be understood that within the scope of the appended claims, the present invention may be practiced other than as specifically described.

What is claimed is:

1. An expansion joint system comprising a cover assembly installed at an expansion gap between a first structural member on one side of the expansion gap and a second structural member on an opposite side of the expansion gap comprising:
- a cover panel having a top side and an underside and bridging the expansion gap;
- at least one moveable pivoting connector joining one edge of the panel to the first structural member to allow pivotal movement about a pivot axis;
- at least one slide support having a top side and a bottom side, which attaches to the second structural member, the slide support including:
  - a flange for attaching the slide support to the structural member,
  - a longitudinal track extending generally perpendicular from the flange,
  - a wedge-shaped lift component located on the longitudinal track and adjacent to the flange, and
  - a downwardly extending protrusion functional as a stop member to limit forward movement, located on the longitudinal track a distance from the flange;
- an angle support bracket selected from at least one of: a two-membered bracket, the members being orthogonal to each other; and a three-membered bracket which is a right isosceles triangle, attached to the second structural member and slidable along the underside of the cover panel; and
- a slide spring assembly for engaging said slide support, said slide spring assembly including
  - a spring plate which attaches to the underside of the cover panel,
  - one or more springs attached to said spring plate, and
  - a guide component which slides over a top portion of the longitudinal track.

2. The expansion joint cover assembly of claim 1 wherein the spring assembly further comprises a saddle component including a proximal groove which engages the slide support and a distal groove to engage the springs.

3. The expansion joint cover assembly of claim 1 wherein the stop member is located on an end portion of the longitudinal track opposite the flange.

4. The expansion joint cover assembly of claim 1 wherein the expansion cover panel includes a groove of a determined length and width formed in the underside thereof for receiving the angle bracket, wherein the angle bracket is slideable in the groove.

5. The expansion joint cover assembly of claim 1 wherein the assembly accommodates displacement of structural panels attached thereto, during a seismic event.

6. The expansion joint cover assembly of claim 1 wherein the pivoting connector is a hinge.

7. An expansion joint system comprising a cover assembly installed at an expansion gap between a first structural member on one side of the expansion gap and a second structural member on an opposite side of the expansion gap comprising:
- a cover panel having a top side and an underside and bridging the expansion gap;
- at least one moveable pivoting connector joining one edge of the panel to the first structural member to allow pivotal movement about a pivot axis;
- at least one slide support which attaches to the second structural member, the slide support including:
  - a flange for attaching the slide support to the structural member,
  - a track extending generally perpendicular from the flange,
  - a lift component located on the track and adjacent to the flange to engage and lift the cover panel, and
  - a stop component located on the track opposite the flange;
- a slide spring assembly for engaging said slide support, said assembly including:
  - a spring plate, wherein the spring plate attaches to the underside of the cover panel,
  - one or more springs attached to said spring plate, and
  - a guide component; and
  - a saddle component having a proximal groove which engages the slide support and a distal groove which engages the springs of the spring assembly.

8. The expansion joint system of claim 7 wherein the cover assembly further comprises at least one angle support attached to the second structural member.

9. The expansion joint system of claim 8 wherein the expansion cover panel includes a groove of a determined length and width formed in the underside thereof for receiving the angle support, and the angle support is slidable within the groove of the cover panel.

10. The expansion joint cover assembly of claim 7 wherein the pivoting connector is a hinge.

11. A seismic expansion joint system for expanding during a seismic event, comprising a cover assembly installed at an expansion gap between a first structural member on one side of the expansion gap and a second structural member on an opposite side of the expansion gap comprising:
- a cover panel having a top side and an underside and bridging the expansion gap;
- at least one moveable pivoting connector joining one edge of the panel to the first structural member to allow pivotal movement about a pivot axis;
- at least one slide support which attaches to the second structural member, the slide support including
  - a flange for attaching the slide support to the second structural member,
  - a track extending generally perpendicular from the flange,
  - a lift component located on the track and adjacent to the flange to engage and lift the cover panel, and a stop component located on the track opposite the flange;

a slide spring assembly for engaging said slide support, said assembly including a spring plate, wherein the spring plate attaches to the underside of the cover panel, one or more springs attached to said spring plate, a guide component, and a saddle component having a proximal groove which engages the slide support and a distal groove which engages the one or more springs of the spring assembly; and wherein the cover panel includes a groove of a determined length and width formed in the underside thereof for receiving at least one angle bracket, and the assembly further includes at least one angle bracket attached to the second structural member slidable within the groove of the cover panel.

* * * * *